US007111601B2

(12) United States Patent
Moenssen et al.

(10) Patent No.: US 7,111,601 B2
(45) Date of Patent: Sep. 26, 2006

(54) AIR INDUCTION SYSTEM HAVING AN ENVIRONMENTALLY RESISTANT ACOUSTIC MEMBRANE

(75) Inventors: David J. Moenssen, Canton, MI (US); Hovie J. Cassell, While Lake, MI (US); Celine J. Dixon, Birmingham, MI (US); Jeff Georgas, Livonia, MI (US); John D. Kostun, Brighton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 2 days.

(21) Appl. No.: 10/803,515

(22) Filed: Mar. 18, 2004

(65) Prior Publication Data

US 2005/0205041 A1 Sep. 22, 2005

(51) Int. Cl.
*F02M 35/10* (2006.01)

(52) U.S. Cl. ..... 123/184.53; 181/229; 181/247

(58) Field of Classification Search ..... 123/198 E, 123/184.21, 184.53, 184.57, 184.61; 181/229, 181/247, 252

See application file for complete search history.

(56) References Cited

U.S. PATENT DOCUMENTS

| | | | | |
|---|---|---|---|---|
| 2,089,492 | A | 8/1937 | Lambert | |
| 2,299,157 | A | 10/1942 | Lowther | |
| 3,061,039 | A * | 10/1962 | Peters | 181/233 |
| 3,205,913 | A | 9/1965 | Ehlers | |
| 3,374,856 | A | 3/1968 | Wirt | |
| 4,192,660 | A | 3/1980 | Ishidera et al. | |
| 4,299,121 | A * | 11/1981 | Asayama et al. | 73/118.1 |
| 4,778,029 | A | 10/1988 | Thornburgh | |
| 5,096,010 | A | 3/1992 | Ojala et al. | |
| 5,333,576 | A * | 8/1994 | Verkleeren | 123/184.57 |
| 5,603,358 | A | 2/1997 | Lepoutre | |
| 5,806,480 | A * | 9/1998 | Maeda et al. | 123/184.57 |
| 5,860,685 | A | 1/1999 | Horney et al. | |
| 5,913,295 | A * | 6/1999 | Sadr et al. | 123/198 E |
| 5,954,096 | A | 9/1999 | Lepoutre | |
| 6,234,211 | B1 | 5/2001 | Lepoutre | |
| 6,464,761 | B1 | 10/2002 | Bugli | |
| 6,553,953 | B1 * | 4/2003 | Fujihara et al. | 181/214 |
| 6,600,408 | B1 * | 7/2003 | Walter et al. | 123/184.21 |
| 2002/0124734 | A1 * | 9/2002 | Spannbauer et al. | 55/385.3 |
| 2003/0062013 | A1 * | 4/2003 | Kino et al. | 123/184.53 |
| 2003/0144418 | A1 * | 7/2003 | Donald et al. | 525/88 |

FOREIGN PATENT DOCUMENTS

| | | | |
|---|---|---|---|
| DE | 3742322 | A1 * | 7/1988 |
| EP | 704617 | A1 * | 4/1996 |
| JP | 57002412 | A * | 1/1982 |

(Continued)

*Primary Examiner*—Noah P. Kamen
(74) *Attorney, Agent, or Firm*—Brinks Hofer Gilson & Lione

(57) ABSTRACT

An air induction system for inducting air into an engine of an automobile is disclosed. The air induction system has an air cleaner and an air inlet tube. The air cleaner is in fluid communication with the engine of the automobile for filtering intake air inducted into the engine. The air inlet tube is made of a first material and is connected at a first end to the air cleaner and open to ambient air at a second end. The inlet tube has a flexible portion that flexes as a result of internal pressure pulsations during the air induction event. The flexing reduces or eliminates acoustic standing waves that have significant pressure fluctuations at the same location in the air induction system as the flexible portion.

26 Claims, 2 Drawing Sheets

FOREIGN PATENT DOCUMENTS

JP 06219144 A * 8/1994

JP 2000356120 A * 12/2000

* cited by examiner

AIR INDUCTION SYSTEM HAVING AN ENVIRONMENTALLY RESISTANT ACOUSTIC MEMBRANE

TECHNICAL FIELD

This invention relates to air induction systems that deliver clean air to an engine's air intake manifold.

BACKGROUND

Internal combustion engines require an air intake or induction system for capturing, cleaning and directing air into the combustion chambers of the engine. Typically, such air induction systems have an air inlet tube attached to the front structure of a vehicle, for example, the front inner fender or behind the headlamps. The inlet tube has an open end for taking in outside air and an opposite end that is connected to an air filter box containing an air filter. The air filter box cleans the intake air by passing it through the filter. In addition, the air filter box provides broadband attenuation of the noise generated by the pressure differential across the inlet valve during the air induction event. The filtered air is then drawn through the air induction outlet tube, through the intake manifold, and into the engine. The clean air is mixed with fuel and the mixture is combusted in the combustion chambers of the engine.

One problem confronting air induction system designers is the noise created by the engine during the air induction event. The noise signature is defined, in part, by the creation of acoustic standing waves that resonate within the air induction system. Prior art induction system designs have tried to address this problem by changing the dimensions of the ducted system as well as including reactive silencers, porous ducts, tuning holes, expansion chambers, etc., within the air induction system. Another problem confronting prior art air induction systems is the collection of water, snow, heat, and debris into the system. Conventional air induction systems addressed this problem by locating the inlet in an environmentally low-risk area of the vehicle. However, while these prior art air inlet tube designs have addressed some of the issues described above, problems still exist.

Therefore, there is a need for an new and improved air induction system having components that address both the collection of water/snow/heat/debris and the noise problems prevalent in prior art systems. The new and improved air induction system will allow the components to be packaged in environments where prior art components couldn't be packaged.

SUMMARY

The present invention is generally directed to an air induction system for inducting air into an engine of an automobile. The air induction system includes an air cleaner, an air outlet tube, an air inlet tube and reactive silencers (e.g., Helmholtz resonators and ¼ wave tuners). The air induction system is in fluid communication with the engine of the automobile for filtering intake air inducted into the engine and attenuating the noise produced during the air induction event. The air inlet tube is made of a first material and connected at a first end to the air cleaner and open to ambient air at a second end. The inlet tube has a flexible portion made of a second material that flexes as a result of internal pressure fluctuations during air induction into the engine. It is understood that the other components of the air induction system may incorporate the flexible portion without departing from the spirit of the invention.

In an aspect of the present invention, the flexible portion includes an aperture disposed along a length of the air induction system and covered with a second material.

In another aspect of the present invention, the second material of the air induction system is a thermoplastic elastomer and is made of an olefin/polypropylene blend.

In yet another aspect of the present invention, the air induction system has a flexible portion located substantially at a central portion of the air inlet tube.

In yet still another aspect of the present invention, the first material of the air intake tube is a polymer.

In yet another aspect of the present invention, the flexible portion of the air induction system has an aperture that is an elongated slot.

In still another aspect of the present invention, a method for reducing noise generated in an air induction system is provided. The method includes determining the dimensions of the air induction system, determining a location along the system where a maximum pressure of an acoustic standing wave(s) is present, forming a flexible portion into a portion of the air induction system, and positioning the flexible portion at the location of the maximum pressure of the acoustic standing wave. Thus, the method of the present invention provides an air induction system that flexes and reduces or eliminates noise generated by standing acoustic waves present in the system.

These and other aspects and advantages of the present invention will become apparent upon reading the following detailed description of the invention in combination with the accompanying drawings.

DESCRIPTION

Figure 1:
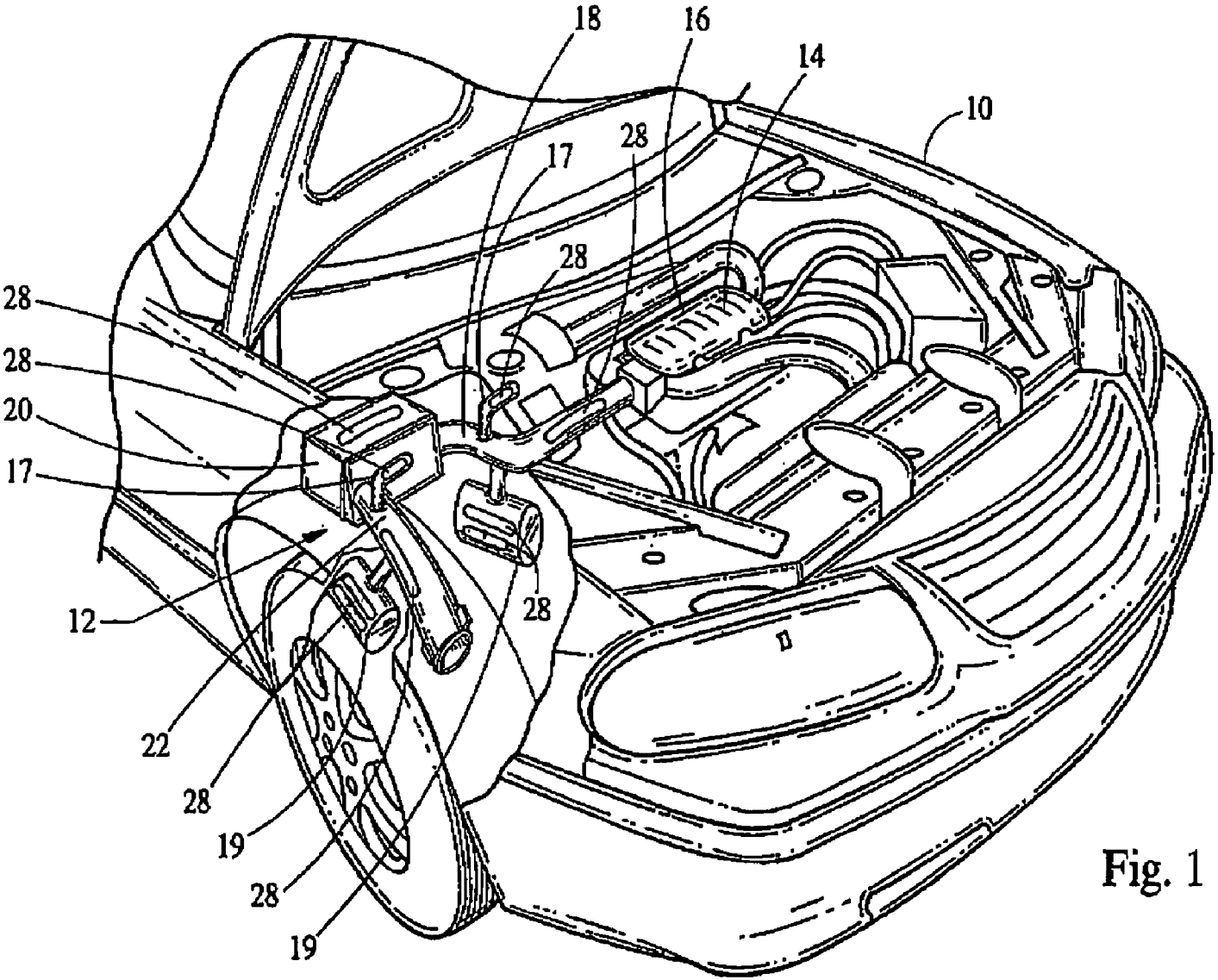
FIG. 1 is a perspective view of an engine and air induction system connected thereto of a vehicle, in accordance with an embodiment of the present invention.

Referring now to FIG. 1, a partial perspective view of a vehicle 10 having an air induction system (AIS) 12 is illustrated, in accordance with an embodiment of the present invention. Vehicle 10 is, generally, an automobile having an engine 14 such as an internal combustion engine which requires a supply of clean ambient air. As generally known, engine 14 mixes the fresh ambient air with an appropriate level of fuel. Engine 14 inducts the ambient air into the cylinders of the engine using AIS 12.

AIS 12 includes an air induction manifold 16, an air outlet duct 18, a filter box 20, and an air intake tube 22. Air intake manifold 16 is of a conventional type that distributes intake air to the various engine cylinders where the air is mixed with a supply of fuel. The manifold 16 is connected to filter box 20 by air outlet duct 18. Filter box 20 typically includes a filter (not shown) which traps debris carried in the ambient air, thereby supplying air manifold 16 with clean air. Air inlet tube 22 communicates ambient air from outside of the air intake manifold into air filter box 20.

It should be understood that various aspects and features of the air induction system 12 may be changed without departing from the scope and spirit of the invention. For example, other air intake manifolds 16, air outlet ducts 18, and air filter boxes 20 may be utilized in combination with air inlet tube 22.

Figure 2:
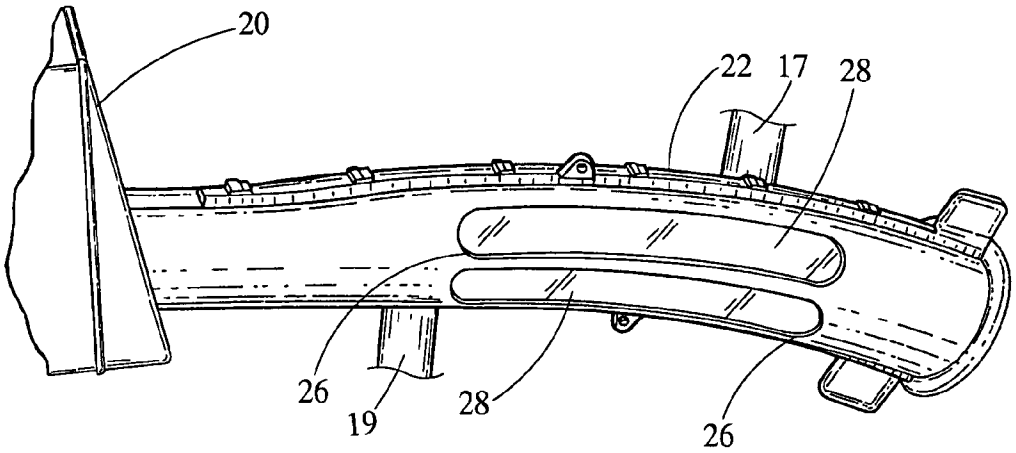
FIG. 2 is a side view of the air inlet tube of the air induction system of the vehicle shown in FIG. 1, in accordance with an embodiment of the present invention.

Referring now to FIG. 2, a perspective view of a first side 21 of air inlet tube 22 is illustrated, in accordance with an aspect of the present invention. Air inlet tube 22 is generally an elongated tubular body connecting air filter box 20 to the ambient air. Depending on the particular vehicle packaging constraints, the tubular body of air inlet tube 22 may include various bends or tapers and the like to fit within the physical constraints of vehicle 10. Generally, air inlet tube 22 is made of polypropylene or other suitable material blended with an additive such as a mineral filler (i.e. mica or talc) to increase the rigidity of the tube.

Air inlet tube 22, in an embodiment of the present invention, includes a plurality of elongated apertures 26. Elongated apertures 26 are formed in the tubular body of inlet tube 22 by various means including injection molding, milling or cutting and the like. The inlet tube is typically made of a thermoplastic material or other suitable polymer. Elongated apertures 26 are covered with a compliant member 28 to form a flexible portion or compliant member 28 of the air inlet tube. Compliant member 28, in an embodiment of the present invention is a thermoplastic elastomer olefin blended with a polypropylene. For example, a material available and known as Santoprene™ may be used for this purpose. Santoprene™ is available through Advanced Elastomer Systems of Akron, Ohio. The present invention contemplates the use of other materials and other thermoplastic elastomers such as PVC, EPDM and the like. In still another embodiment of the present invention, compliant member 28 is a layer of a thermoplastic elastomer olefin blended with a polypropylene or other suitable material that is substantially thinner than the wall of the air intake tube. For example, compliant member 28 may be 0.5 to 1.5 millimeters thick, while the rest of the inlet tube 22 is between 2.0 and 3.0 millimeters thick.

Compliant member 28 is configured to undergo flexing relative to inlet tube 22 to reduce or eliminate the maximum pressure generated in the inlet tube by resonating standing waves. Typically, the standing wave, which is an acoustic wave, will be generated in a given length of inlet tube and will have a maximum pressure along discrete portions of the tube. As the pressure builds up through the formation of the standing wave, compliant member 28 flexes relative to the inlet tube 22 and reduces or eliminates the resonating acoustic wave. In this manner, the embodiments of the present invention significantly reduce or eliminate the noise generated by AIS 12. While elongated apertures 26 and compliant material 28 are shown generally along a central portion of inlet tube 22, the present invention contemplates other locations and positioning of the apertures and compliant material. For example, in other embodiments of the present invention, a single aperture covered with a compliant material may be used. On the other hand, in still other embodiments, two or more elongated apertures covered by compliant member 28 may be utilized. Inlet tube 22 may be formed by joining two elongated C-shaped (in cross-section) halves or by one unitary body.

In still other embodiments of the present invention, compliant member 28 may be located on other components of AIS 12. For example, compliant member 28 may be disposed on air outlet tube 18 or air filter box 20, as shown in FIG. 1. Furthermore, if AIS 12 has quarter wave tuners 17, resonators 19 or the like, complaint member 28 may be disposed on these components as well, as illustrated in FIG. 1.

Figure 3:
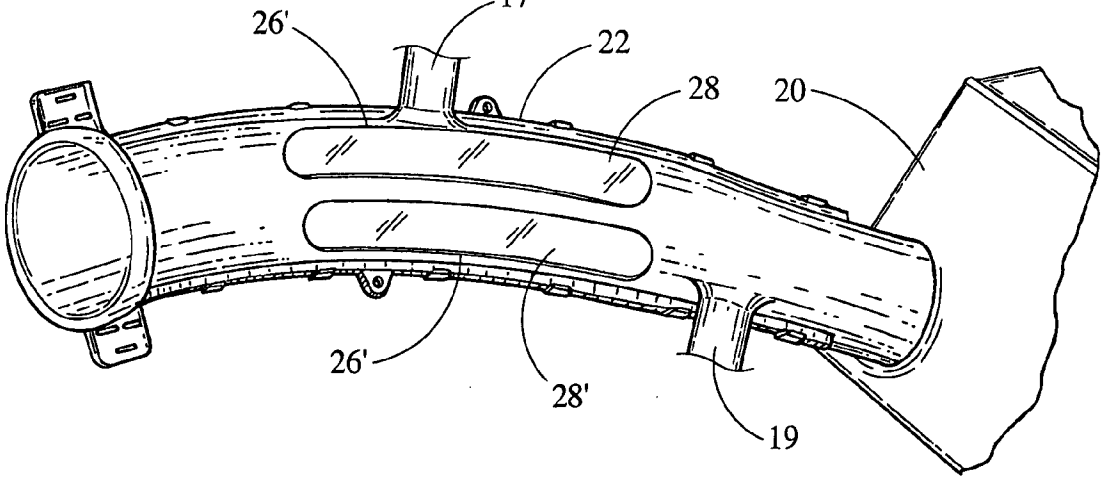
FIG. 3 is a side view of the opposite side of the air inlet tube shown in FIG. 2, in accordance with an embodiment of the present invention.

Referring now to FIG. 3, the opposite side 25 of inlet tube 22 is illustrated, in accordance with an embodiment of the present invention. As illustrated, side 25 of inlet tube 22 may have one or more elongated apertures 26' as well. Apertures 26' are covered with compliant material 28 as disclosed previously with regard to the side 21 of inlet tube 22. Apertures and compliant covering 26', 28 are positioned generally along a central portion of inlet tube 22, however, the present invention contemplates other locations such as closer to either end of inlet tube 22. Additional compliant portions 28 covering aperture 26' allow for a further reduction in standing waves created in inlet tube 22. Of course, suitable attachment features may be incorporated into or attached to inlet tube 22 to secure the inlet tube to the vehicle body.

In yet another embodiment of the present invention, a method for constructing air inlet tube 22 is provided. Before compliant member 28 is formed into the air intake tube a determination is made, based on the dimensions of the tube, as to where along the length of the tube the points or areas of maximum pressure exist from the creation of the acoustic standing wave(s). Once the maximum pressure points or areas are identified the air inlet tube may be constructed according to the following process, for example. In an initial step, air inlet tube 22 is formed by injection molding a first and second elongated half (the first half is shown in FIG. 2 and the second half is shown in FIG. 3). Of course, other molding processes may be utilized and are contemplated by the present invention. In a second step, compliant material 28 is over-molded over apertures 26 and 26' that are disposed on the elongated apertures. The over molding process of the second step is a conventional process wherein the molded first and second halves are placed in a second mold and the compliant material is injection molded into the second mold. During the over-molding process, compliant member 28 fuses to the premolded air inlet tube halves and covers elongated apertures 26 and 26'. Of course, the present invention contemplates other methods for covering elongated apertures 26 and 26' with compliant member 28. For example, compliant material 28 may be heat staked or glued to the inner or outer surfaces of the inlet tube.

Thus, the present invention has many advantages and benefits over the prior art. For example, the air inlet tube of the present invention reduces or eliminates acoustic noise generated by standing waves resonating in the air inlet tube. A compliant material is provided in the inlet tube that is resistant to the harsh environments of an automobile and thus can be packaged in areas on the vehicle that were previously unavailable. Further, it follows from the description of the various embodiments of the present invention that the thickness of complaint member 28 should be decreased relative to thickness of the duct if more acoustic wave dissipation is required and increased if less acoustic wave dissipation is required.

As any person skilled in the art of air induction systems for engines will recognize from the previous detailed description and from the figures and claims, modifications and changes can be made to the preferred embodiments of the invention without departing from the scope of this invention defined in the following claims. It is further understood that other ducted-system applications requiring the dissipation of acoustic standing waves would also benefit from the incorporation of a properly located flexible membrane (i.e. compliant member 28).

We claim:

1. An air induction system for inducting air into an engine of an automobile, the system comprising:

a duct in fluid communication with the engine of the automobile for directing inducted intake air into the engine; and a first compliant member formed in a wall of a quarter wave tuner, wherein the quarter wave tuner is connected to the duct and wherein the duct is made of a first material and the first compliant member is made of a second material that flexes as a result of an internal pressure fluctuation during air induction into the engine, and wherein the first compliant member includes an elongated slot disposed along a length of the wall of the duct and covered with the second material.

2. The air induction system of claim 1 wherein the second material is a thermoplastic elastomer.

3. The air induction system of claim 2 wherein the thermoplastic elastomer is an olefin/polypropylene blend.

4. The air induction system of claim 1 wherein the first material is a polymer.

5. The air induction system of claim 1 wherein the first compliant member has a thickness that is less than half of a thickness of the wall of the duct.

6. The air induction system of claim 1 further comprising a second compliant member disposed on a resonator of the air induction system.

7. The air induction system of claim 6 further comprising a third compliant member disposed on a wall of an air filter box in fluid communication with the duct of the air induction system.

8. A method for reducing noise generated in an air induction system, the method comprising:

determining a length of an air duct;

determining a location along the duct where a maximum pressure of an acoustic standing wave is present;

forming a flexible portion of a second material into a wall of a quarter wave tuner connected to the duct, wherein the second material is over-molded over the duct; and positioning the flexible portion at the location of the maximum pressure of the acoustic standing wave.

9. The method of claim 8, further comprising forming the duct out of a first material.

10. The method of claim 8, wherein forming a flexible portion further comprises forming an aperture in the portion of the duct.

11. The method of claim 10, wherein forming a flexible portion further comprises covering the aperture with a thin layer of a polymer material.

12. The method of claim 10, wherein forming a flexible portion further comprises covering the aperture with a thin layer of an olefin/polypropylene blend.

13. The method of claim 8, wherein forming further comprises fixing the thin layer of polymer material to the duct over the aperture.

14. An air induction system for inducting air into an engine of an automobile, the system comprising:

a duct in fluid communication with the engine of the automobile for directing inducted intake air into the engine;

a first compliant member formed in a wall of a quarter wave tuner connected to the duct, wherein the duct is made of a first material and the first compliant member is made of a second material that flexes as a result of an internal pressure fluctuation during air induction into the engine, wherein the compliant member includes an elongated slot disposed along a length of the duct and covered with the second material; and wherein the first compliant member has a thickness that is less than half of a thickness of the wall of the quarter wave tuner.

15. The air induction system of claim 14 a wherein the second material Is a thermoplastic elastomer.

16. The air induction system of claim 15 wherein the thermoplastic elastomer is an olefin/polypropylene blend.

17. The air induction system of claim 14 further comprising a second compliant member is located at a portion of an air inlet tube of the air induction system that allows for dissipation of one or more acoustic standing waves.

18. The air induction system of claim 14 wherein the first material is a polymer.

19. The air induction system of claim 14 further comprising a second compliant member disposed on a resonator of the air induction system.

20. The air induction system of claim 17 further comprising a third compliant member disposed on en air filter box in fluid communication with the duct of the air induction system.

21. A method for reducing noise generated in an air induction system, the method comprising:

determining a length of an air duct;

determining a location along the duct where a maximum pressure of an acoustic standing wave is present;

forming a flexible portion of a second material into a wall of a quarter wave tuner connected to the duct, wherein the flexible portion has a thickness less than half the thickness of the duct and wherein the second material is over-molded over the duct; and positioning the flexible portion at the location of the maximum pressure of the acoustic standing wave.

22. The method of claim 21, further comprising forming the duct out of a first material.

23. The method of claim 21, wherein forming a flexible portion further comprises forming an aperture in the portion of the duct.

24. The method of claim 23, wherein forming a flexible portion further comprises covering the aperture with a thin layer of a polymer material.

25. The method of claim 23, wherein forming a flexible portion further comprises covering the aperture with a thin layer of an olefin/polypropylene blend.

26. The method of claim 21, wherein forming further comprises fixing the thin layer of polymer material to the duct over the aperture.

* * * * *

UNITED STATES PATENT AND TRADEMARK OFFICE

CERTIFICATE OF CORRECTION

PATENT NO. : 7,111,601 B2
APPLICATION NO. : 10/803515
DATED : September 26, 2006
INVENTOR(S) : David J. Moenssen et al.

It is certified that error appears in the above-identified patent and that said Letters Patent is hereby corrected as shown below:

In the Claims

Column 5, in claim 1, line 8, immediately after "to the duct" insert --,-- (comma).

Column 6, in claim 15, line 2, after "second material" delete "Is" and substitute --is-- in its place.

Column 6, in claim 20, line 2, after "member disposed on" delete "en" and substitute --an-- in its place.

Signed and Sealed this

Second Day of January, 2007

JON W. DUDAS
*Director of the United States Patent and Trademark Office*